US009901841B2

(12) United States Patent
Ryaa

(10) Patent No.: US 9,901,841 B2
(45) Date of Patent: Feb. 27, 2018

(54) TOY BUILDING SET

(75) Inventor: Jan Ryaa, Billund (DK)

(73) Assignee: LEGO A/S (DK)

( * ) Notice: Subject to any disclaimer, the term of this patent is extended or adjusted under 35 U.S.C. 154(b) by 140 days.

(21) Appl. No.: 13/880,014

(22) PCT Filed: Oct. 18, 2011

(86) PCT No.: PCT/DK2011/050391

§ 371 (c)(1),
(2), (4) Date: Aug. 22, 2013

(87) PCT Pub. No.: WO2012/052025

PCT Pub. Date: Apr. 26, 2012

(65) Prior Publication Data

US 2013/0330999 A1 Dec. 12, 2013

(30) Foreign Application Priority Data

Oct. 21, 2010 (DK) ..... 2010 00953

(51) Int. Cl.
*A63H 33/08* (2006.01)
*A63H 33/04* (2006.01)

(52) U.S. Cl.
CPC ..... *A63H 33/04* (2013.01); *A63H 33/042* (2013.01); *A63H 33/086* (2013.01)

(58) Field of Classification Search
CPC ..... A63H 33/042; A63H 33/086; A63H 33/04
USPC ..... 446/119, 120, 121, 122, 124, 125, 128
See application file for complete search history.

(56) References Cited

U.S. PATENT DOCUMENTS 2,423,002 A * 6/1947 Bray ..... A41D 13/04 2/51
2,575,054 A * 11/1951 Gowdy ..... A41B 13/04 2/402
2,649,803 A 8/1953 Andre et al.
3,233,358 A 2/1966 Dehm
3,236,004 A 2/1966 Christiansen
3,324,619 A 6/1967 Gearhard
(Continued)

FOREIGN PATENT DOCUMENTS

CH 389481 A 3/1965
CN 85101526 A 1/1987
(Continued)

OTHER PUBLICATIONS

International Search Report for co-pending international application PCT/DK2011/050391, dated Feb. 23, 2012.
(Continued)

*Primary Examiner* — Vishu Mendiratta
(74) *Attorney, Agent, or Firm* — Day Pitney LLP

(57) ABSTRACT

A toy building element comprising toy building elements for building a turntable, said toy building elements comprising a first type (1) which is provided with a rotation shaft and at least one second and one third type of toy building elements (5, 6), each of which can be interconnected with the first type for forming a turntable; and wherein the toy building elements are configured such that, when the first and the second type of toy building element are interconnected, a higher coupling force is accomplished than the one which is accomplished when the first and the third type of toy building element are interconnected.

10 Claims, 1 Drawing Sheet

(56) References Cited

U.S. PATENT DOCUMENTS

| | | | | | |
|---|---|---|---|---|---|
| 3,415,155 | A | * | 12/1968 | Riddell | F16C 33/20 384/297 |
| 3,425,314 | A | | 2/1969 | Ohlson | |
| 3,510,979 | A | | 5/1970 | Fischer | |
| 3,513,588 | A | | 5/1970 | Fischer | |
| 3,551,963 | A | * | 1/1971 | Mosher | A44B 17/0029 24/618 |
| 3,553,882 | A | | 1/1971 | Meates | |
| 3,713,248 | A | | 1/1973 | Heubl | |
| 4,037,978 | A | * | 7/1977 | Connelly | 403/164 |
| 4,124,949 | A | | 11/1978 | Bach et al. | |
| 4,176,582 | A | | 12/1979 | Witte | |
| 4,375,139 | A | | 3/1983 | Chatani | |
| 4,506,408 | A | | 3/1985 | Brown | |
| 4,551,110 | A | | 11/1985 | Selvage et al. | |
| 4,604,073 | A | | 8/1986 | Livesey et al. | |
| 4,740,189 | A | | 4/1988 | Bertrand | |
| 4,764,144 | A | * | 8/1988 | Lyman | 446/128 |
| 4,947,527 | A | * | 8/1990 | Hennig | 24/586.11 |
| 5,049,104 | A | | 9/1991 | Olsen | |
| 5,360,364 | A | | 11/1994 | Poulsen et al. | |
| 5,427,558 | A | | 6/1995 | Knudsen et al. | |
| 5,503,497 | A | | 4/1996 | Dudley et al. | |
| 5,538,452 | A | | 7/1996 | Kurani | |
| 5,582,488 | A | | 12/1996 | Dudley et al. | |
| 5,600,870 | A | | 2/1997 | Fields et al. | |
| 5,769,681 | A | | 6/1998 | Greenwood, Sr. et al. | |
| 5,779,515 | A | | 7/1998 | Chung | |
| 6,030,270 | A | | 2/2000 | Krog | |
| 6,461,215 | B1 | | 10/2002 | Kunz et al. | |
| 6,491,567 | B2 | | 12/2002 | Chan | |
| 6,540,461 | B1 | | 4/2003 | Hawang | |
| 6,595,825 | B1 | | 7/2003 | De Wilde | |
| 6,736,691 | B1 | | 5/2004 | Bach | |
| 7,175,501 | B2 | | 2/2007 | Choi | |
| 7,736,211 | B2 | | 6/2010 | Marzetta | |
| 8,047,890 | B1 | | 11/2011 | Haas | |
| 8,157,470 | B2 | | 4/2012 | De Wilde | |
| 8,888,552 | B2 | | 11/2014 | Wizenberg et al. | |
| 2006/0264147 | A1 | | 11/2006 | Shoptaugh | |
| 2007/0277459 | A1 | | 12/2007 | Marzetta | |
| 2008/0175656 | A1 | | 7/2008 | Blattner et al. | |
| 2010/0210173 | A1 | * | 8/2010 | Maggiore | A63H 33/062 446/125 |
| 2013/0084767 | A1 | | 4/2013 | McDonald | |
| 2013/0316610 | A1 | | 11/2013 | Maddocks et al. | |

FOREIGN PATENT DOCUMENTS

| | | | |
|---|---|---|---|
| CN | 201220122 | Y | 4/2009 |
| EP | 1099460 | A2 | 5/2001 |
| EP | 1149618 | A2 | 10/2001 |
| FR | 1198239 | A | 12/1959 |
| GB | 553918 | A | 6/1943 |
| GB | 634468 | A | 3/1950 |
| GB | 1314965 | A | 3/1973 |
| GB | 2426213 | A | 11/2006 |
| JP | S51-45320 | | 4/1976 |
| JP | S59-159497 | U | 10/1984 |
| JP | H02063897 | U | 5/1990 |
| JP | H04503618 | A | 7/1992 |
| JP | 7-55266 | B2 | 6/1995 |
| JP | 3069452 | U | 3/2000 |
| JP | 2003-508138 | A | 3/2003 |
| JP | 2007050064 | A | 3/2007 |
| JP | 2008020063 | A | 1/2008 |
| JP | 2009100882 | A | 5/2009 |
| WO | 1993/022018 | A1 | 11/1993 |

OTHER PUBLICATIONS

Written Opinion of the International Searching Authority for co-pending international application PCT/DK2011/050391.

International-Type Search Report issued from the Danish Patent and Trademark Office for priority application PA 2010 00953, dated Mar. 9, 2011.

Notification of Reasons for Refusal issued in corresponding Japanese patent application No. 2013-534166, dated Nov. 24, 2015 (with computer-generated English translation)

International Search Report for corresponding international application No. PCT/DK2011/050392, dated Feb. 22, 2012.

DK Office Action issued from the Danish Patent and Trademark Office, for priority application DK PA 2010 00955, dated May 12, 2011 together with list of relevant documents, dated May 10, 2011. (in the Danish language).

International-Type Search Report issued from the International Searching Authority, for priority application DK PA 2010 00955, dated Mar. 10, 2011.

USPTO's Non-Final Office Action issued in related U.S. Appl. No. 13/880,591, dated Feb. 27, 2015.

Notification of Reasons for Refusal issued in related Japanese patent application No. 2013-534166, dated Nov. 24, 2015 (with computer-generated English translation).

Notification of Reasons for Refusal issued in related Japanese patent application No. 2013-534167, dated Nov. 25, 2015 (with computer-generated English translation).

Notification of Reasons for Refusal issued in related Japanese patent application No. 2013-534166, dated Oct. 6, 2016 (with computer-generated English translation).

* cited by examiner

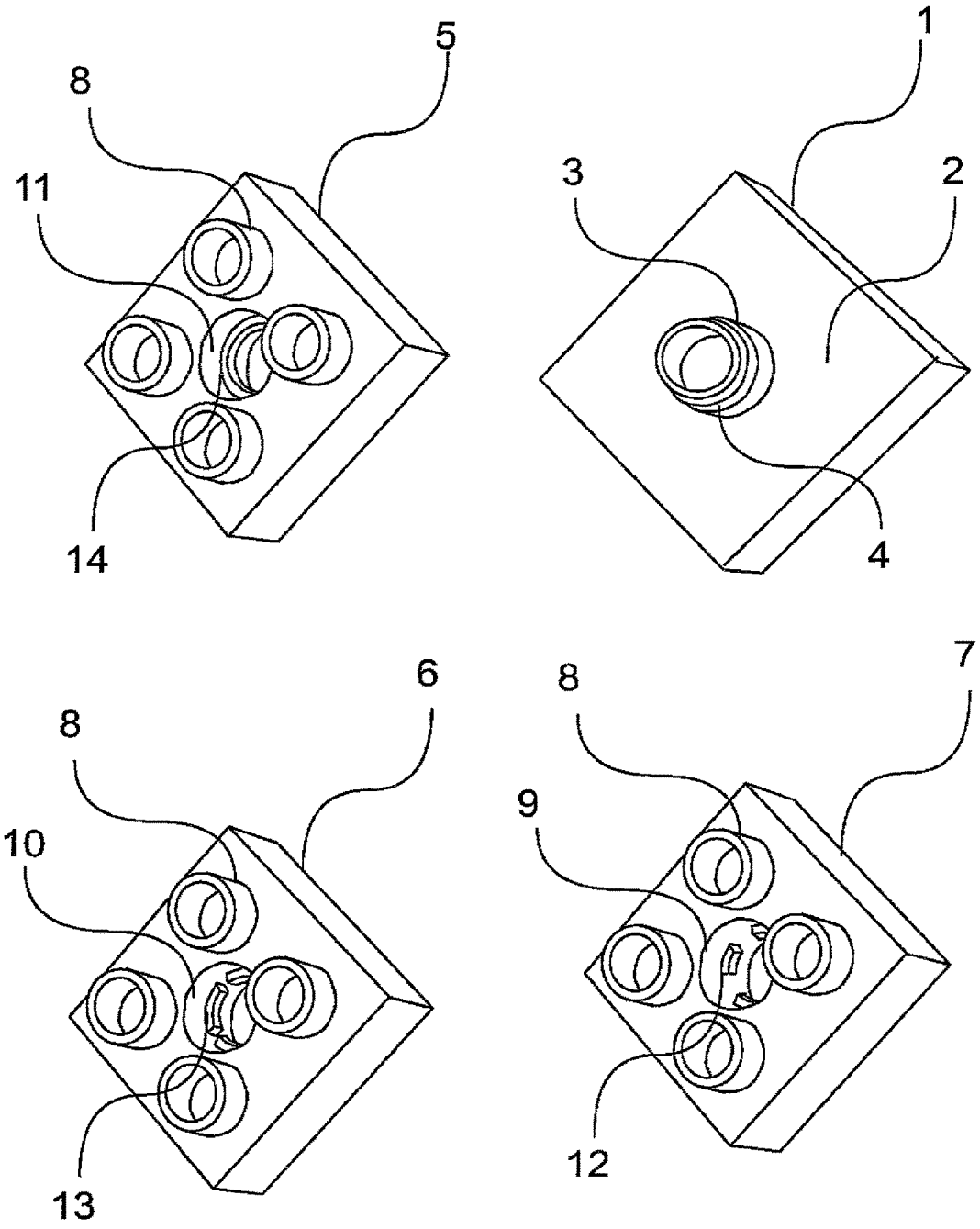
5
8
11
14
1
3
2
4
6
8
10
13
7
8
9
12

TOY BUILDING SET

CROSS-REFERENCE TO RELATED APPLICATIONS

This application is the U.S. National Stage of International Application No. PCT/DK2011/050391, filed on Oct. 18, 2011, and published on Apr. 26, 2012 as WO 2012/052025, which claims the benefit of priority to Danish Patent Application Serial No. PA 2010 00953, filed on Oct. 21, 2010.

FIELD OF APPLICATION OF THE INVENTION

The present invention relates to a toy building set comprising at least one first building element, on which a rotation shaft located along an axis of rotation is arranged; and wherein the toy building set comprises at least one second building element in which a rotation bushing is provided which is configured for receiving and being interconnected with the rotation shaft on the first building element in such a manner that the two building elements can rotate relative to each other about the axis of rotation; and wherein, at the rotation shaft and the rotation bushing, respectively, complementary coupling means are configured for forming a snap connection for interconnection of the rotation shaft and the rotation bushing in such a manner that they cannot be interconnected with or disconnected from each other along the axis of rotation without the snap function being activated by a given force impact along the axis of rotation.

STATE OF THE ART

Today, toy building sets of the kind set forth above are known in various embodiments, wherein the two toy building elements can be interconnected by means of the rotation shaft and the rotation bushing, whereby it is possible to form eg a turntable which can be used for a wide range of purposes when used during the building of a construction consisting of other toy building elements or toy building blocks.

It is a problem of those prior art toy building elements that their holding force is limited by the force which a child is capable of providing for interconnecting the two building elements, and thereby that they impose limitations as to the use thereof in a concrete building structure, it being limited how much force can be imposed on a turntable built from those toy building elements.

Therefore, other types of toy building sets are known that comprise pre-assembled turntables that are mounted by the manufacturer and which cannot be dismounted without the turntable being destroyed.

OBJECT OF THE INVENTION

Based on this, it is the object of the present invention to provide a toy building set of the kind described above, whereby it is possible, by means of relatively few individual components, to construct a wider range of different constructions.

This is accomplished in that the toy building element comprises at least one third type of building element, said building element comprising a rotation shaft or a rotation bushing which has respective complementary coupling means for forming a snap connection for interconnecting the third type of building element to the rotation bushing or the rotation shaft, respectively, on the second or the first type of building element, and wherein the complementary coupling means on the third type of building element are configured such that it requires a smaller impact of force to mount the third type of building element on the first or the second type of building element, respectively, than the force needed to interconnect the first type of building element to the second type of building element.

It is thus possible, said toy building set thus comprising the option of optionally building, by use of merely three separate toy building elements, a turntable having a relatively large holding force or a corresponding turntable having a smaller holding force, to enable the building of eg constructions where only a grown-up person is capable of mounting the turntable, and other constructions wherein the turntable can easily be mounted by a small child.

Another advantage obtained thereby is that, when moulding the toy building elements from eg plastics, only three different mould cavities are needed, whereas, by the prior art technique, moulds are to be used that have at least four different mould cavities.

According to the invention, it is furthermore possible to have more than two different interconnection options to the effect that there may be eg a fourth type of toy building element which, when interconnected to another toy building element, provides a further reduced holding force in the snap connection to the effect that it is possible to bring about three levels of holding force, viz a first level at which a turntable requires assembly by means of a tool in order to overcome the force needed to interconnect the snap connection, a second level at which a grown-up person will usually have sufficient force to assemble the turntable by hand, and a third level at which eg a small child will have sufficient force to assemble the turntable by hand.

According to a preferred embodiment of the invention, the force needed to interconnect the snap connection between a building element of the third type and the first or the second building element of the toy building set, is thus less than 90%, and preferably less than 80%, of the force needed to interconnect the snap connection between the first type of building element and the second type of building element.

According to a concrete embodiment, the complementary coupling means on the first and the second type of toy building element will comprise a groove extending into the outer side of and all the way around on the rotation shaft on the first type of toy building element, and one or more ribs are arranged on the inner side of the rotation bushing in such a way that each of the ribs engages with the groove when the two building elements are interconnected by means of the snap connection.

In this context, the reduced coupling force could be obtained in that the complementary coupling means on the third type of toy building element comprise a rotation bushing corresponding essentially to the rotation bushing on the second type of toy building element; and in that the complementary coupling means on the third type of toy building element also comprise at least one rib arranged on the inner side of the rotation bushing in such a manner that each individual rib has a height or a width which is smaller than each individual rib on the second type of toy building element.

However, particularly advantageously this is accomplished by the second and the third toy building element comprising more than one rib; and in that the distance between two adjacent ribs on the third toy building element is larger than the corresponding distance between two adjacent ribs on the second toy building element.

The required elasticity of the snap connection can be obtained if the rotation bushing on the second and the third type of toy building element or the rotation shaft on the first type of toy building element is configured as a tube.

The invention is particularly advantageous in relation to toy building elements each of which has a substantially plane surface arranged at right angles relative to the axis of rotation; and in that the plane surface of the first type of toy building element abuts on the plane surface of the second or the third type of toy building element, when the two toy building elements are interconnected by means of the rotation shaft and the rotation bushing. Thereby it is difficult to twist the two toy building elements apart, it being to a higher degree necessary to separate them by pulling them apart along the common axis of rotation.

In this context, it is furthermore advantageous if the rotation shaft extends outwards from the surface of the first type of toy building element.

LIST OF FIGURES

FIG. 1: is a perspective view showing a set of building elements according to the present invention, seen in an inclined view from above.

EMBODIMENT OF THE INVENTION

Thus, FIG. 1 shows four different building elements 1, 5, 6, 7, wherein the first building element 1 comprises a box-shaped body member having a plane surface 2, on which, from the plane surface 2, a rotation shaft 3 extends in the form of a circular cylindrical tube being, on its outer side, provided with a groove 4 that extends uninterruptedly all the way around the rotation shaft 3 on the outside thereof.

Moreover, FIG. 1 shows three other building elements 5, 6, 7, all of which have a box-shaped body member, on which, on each member, a total of four coupling studs 8 are arranged that have a shape which allows that those building elements can be interconnected with other building elements (not shown) in a toy building set which is known as such.

Moreover, each of the other building elements 5, 6, 7 is provided with a rotation bushing 9, 10, 11 which is configured such that the rotation shaft 3 on the first building element 1 can be introduced into any one of those rotation bushings 9, 10, 11, following which the unit as a whole forms a turntable, wherein the first building element 1 is capable of rotating about an axis of rotation relative to the second building element 9, 10, 11 with which the first element is interconnected.

In order to secure the other building elements 9, 10, 11 in the interconnected state on the first building element 1, each of the rotation bushings 9, 10, 11 on the other building elements 5, 6, 7 is provided with at least one rib 12, 13, 14 extending around on the inner side of the rotation bushings 9, 10, 11. The ribs 12, 13, 14 are configured such that the rotation shaft 3 on the first building element 1 can be pressed into each of the rotation bushings 9, 10, 11 only in case one specific force is exerted to the effect that a snap function is thereby formed.

As will appear, the rib 14 on one of the other building elements 5 is configured as a continuous rib extending uninterruptedly around on the inner side of the rotation bushing 11, whereas it will appear that the ribs 12 and 13 on the other rotation bushings 9 and 10, respectively, on the respective building elements 6 and 7 are configured as four individual ribs 12 and 13 that sit in succession of one another with a distance between them, and such that they combine to form an interrupted rib which, in the same manner as the rib 14 on the building element 5, extends around on the inner side of the rotation bushings 9 and 10 and has the same function, viz to provide a snap connection between the first building element 1 and one of the other building elements 5, 6, 7.

Moreover, it will appear that the distance between the individual ribs 12 on the one of the two other building elements 7 is greater than the corresponding distance between the individual ribs 13 on the other one of the two other building elements 6.

Thereby the option is provided of building three different turntables by interconnection of the first building element 1 with one of the other building elements 5, 6, 7, it being accomplished, due to the different configurations of the ribs 12, 13, 14, that the magnitudes of force needed to press the rotation shaft 3 into one of the rotation bushings 9, 10, 11, respectively, are different, in that the continuous rib 14 on the second element 5 requires the largest force impact, and in that the ribs 12 on the second element 7 require the smallest force, the distance between the ribs 12 being larger than the distance between the ribs 13 on the second building element 6.

To the person skilled in the art it will be obvious that this fundamental principle can be varied relative to the embodiment shown in the figures, since eg the box-shaped body member on the building elements 1, 5, 6, 7 may have other shapes than the one shown, such as a rectangular shape, circular shape, or other. The coupling studs 8 may also be varied as to number and shape depending on the building system for which the building elements are intended to be used.

In this context, the definition 'toy building set' is used to describe a building system comprising a plurality of building elements that are compatible with and hence can be interconnected with the building elements according to the invention. A building system may thus consist of one or more separate building sets, each of which may be packed in a separate packaging.

The invention claimed is:

1. A toy building set comprising:

at least one first building element, comprising a rotation shaft extending therefrom along an axis of rotation, the rotation shaft in the form of a circular cylindrical tube having a groove extending uninterruptedly around an outside surface of the rotation shaft;

at least one second building element, comprising a set of coupling studs on a top planar surface thereof for interconnection with recesses of other corresponding building elements, and a first rotation bushing extending perpendicularly through the body of the second building element with respect to the top planar surface thereof and configured for receiving and being interconnected with the rotation shaft on the first building element on a bottom surface of the second type of building element in such a manner that the two building elements can rotate relative to each other about the axis of rotation;

wherein the rotation shaft and the rotation bushing together form a complementary coupling means for forming a snap connection there-between along the axis of rotation;

wherein the toy building set further comprises at least one third building element comprising a set of coupling studs on a top planar surface thereof for interconnection with recesses of other corresponding building elements, and a second rotation bushing extending perpendicularly through the body of the third building element with respect to the top planar surface thereof, the second rotation bushing and the rotation shaft of the first building element forming a complementary coupling means for forming a snap connection there-between;

wherein the first rotation bushing comprises one continuous rib extending uninterruptedly around an inner side of the first rotation bushing;

wherein the second rotation bushing comprises a plurality of ribs provided in succession of one another with a mutual distance between them such that the plurality of ribs combine to form an interrupted rib around an inner side of the second rotation bushing; and wherein interconnection between the first building element and the third building element is configured to create a different rotatable interconnection than interconnection between the first building element and the second building element.

2. A toy building set according to claim 1, wherein a force needed to interconnect the snap connection between the first building element and the third building element is less than 90%, and preferably less than 80%, of a force needed to interconnect the first building element and the second building element.

3. A toy building set according to claim 1, further comprising at least one fourth building element comprising a third the third rotation bushing and the rotation shaft of the first building element forming a complementary coupling means for forming a snap connection there-between, wherein the third rotation bushing comprises the same number of ribs as the second rotation bushing, wherein the mutual distance between two adjacent ribs on the third rotation bushing is larger than the corresponding mutual distance between two adjacent ribs on the second rotation bushing.

4. A toy building set according to claim 1, wherein the rotation bushings on the second and on the third building elements are configured as a tube.

5. A toy building set according to claim 1, wherein the height and width of the ribs in the third rotation bushing are smaller than the height and width of the ribs in the second rotation bushing.

6. A toy building set according to claim 1, wherein each of the toy building elements has a substantially plane surface arranged at right angles relative to the axis of rotation; and wherein the plane surface of the first building element abuts the plane surface of the second or third building element when the two building elements are interconnected by means of the rotation shaft and the first or second rotation bushing.

7. A toy building set comprising:

at least one first building element, comprising a rotation shaft extending therefrom along an axis of rotation, the rotation shaft in the form of a circular cylindrical tube having a groove extending around an outside surface of the rotation shaft;

at least one second building element, comprising a set of coupling studs on a top planar surface thereof for interconnection with recesses of other corresponding building elements, and a generally cylindrical first rotation bushing extending perpendicularly through the body of the second building element with respect to the top planar surface thereof and configured for receiving and being interconnected with the rotation shaft on the first building element on a bottom surface of the second type of building element in such a manner that the two building elements can rotate relative to each other about the axis of rotation, wherein the rotation shaft and the rotation bushing together form a complementary coupling means for forming a snap connection there-between along the axis of rotation; and at least one third building element comprising a set of coupling studs on a top planar surface thereof for interconnection with recesses of other corresponding building elements, and a generally cylindrical second rotation bushing extending perpendicularly through the body of the third building element with respect to the top planar surface thereof, the second rotation bushing and the rotation shaft of the first building element forming a complementary coupling means for forming a snap connection there-between that is different from the snap connection between the first building element and the second building element;

wherein the first rotation bushing comprises one or more ribs extending around an inner side of the first rotation bushing; and wherein the second rotation bushing comprises one or more ribs provided in succession of one another with a mutual distance between them such that the plurality of ribs combine to form an interrupted rib around an inner side of the second rotation bushing, the ribs in the second rotation bushing having a height and width that is smaller than the height and width of the ribs in the first rotation bushing.

8. The toy building set of claim 7, wherein the one or more ribs in the first rotation bushing of the second building element forms a continuous, uninterrupted ridge, and the one or more ribs in the second rotation bushing of the third building element forms an interrupted ridge.

9. The toy building set of claim 7, further comprising a fourth building element having a set of coupling studs on a top planar surface thereof for interconnection with recesses of other corresponding building elements and defining a generally cylindrical third rotation bushing having one or more radially inwardly oriented rib formed on a surface of the cavity for receiving the groove of the generally cylindrical shaft of the first building element to form a turntable, wherein a height and width of the one or more ribs of the third rotation bushing are smaller than the height and width of the ribs in the second rotation bushing.

10. The toy building set of claim 9, wherein the one or more ribs in the third rotation bushing form a continuous ridge.

* * * * *